United States Patent [19]

Lautensleger et al.

[11] 4,408,423

[45] Oct. 11, 1983

[54] ROOF CONSTRUCTION WITH STABILIZED Z-PURLINS

[75] Inventors: Richard W. Lautensleger; George R. Bingham, both of Middletown, Ohio; Peter J. Trepanier, Houston, Tex.

[73] Assignee: Armco Inc., Middletown, Ohio

[21] Appl. No.: 26,187

[22] Filed: Apr. 2, 1979

Related U.S. Application Data

[63] Continuation of Ser. No. 844,609, Oct. 25, 1977.

[51] Int. Cl.[3] ..... E04B 7/00; E04D 13/00

[52] U.S. Cl. ..... 52/90

[58] Field of Search ..... 52/696, 45–56, 52/86, 90, 261, 262, 92; 244/119, 131, 130; 296/181; 105/397

[56] References Cited

U.S. PATENT DOCUMENTS

| | | | |
|---|---|---|---|
| 2,314,979 | 3/1943 | Gunn | 105/401 |
| 3,092,221 | 6/1963 | Parsons | 52/90 |
| 3,157,251 | 11/1964 | Rasch | 52/93 |
| 3,796,014 | 3/1974 | Garbrick | 52/90 |
| 3,849,012 | 11/1974 | Krouse | 52/90 |
| 3,973,367 | 8/1976 | Johnson | 52/90 |

FOREIGN PATENT DOCUMENTS

| | | | |
|---|---|---|---|
| 1028906 | 5/1966 | United Kingdom | 52/90 |

*Primary Examiner*—John E. Murtagh

*Attorney, Agent, or Firm*—Frost & Jacobs

[57] ABSTRACT

A roof construction having at least one roof slope is disclosed wherein at least four Z-purlins are laid across and secured to a number of rafters on the roof slope in a building and the roof deck is then secured on top of the Z-purlins. Tendencies toward Z-purlin roll over failure are counter balanced when at least two of the Z-purlins on the roof slope are oriented to face downwardly of the roof slope and at least two of the Z-purlins on the roof slope are oriented to face upwardly of the roof slope. The downwardly and upwardly oriented Z-purlins may be arranged in pairs of adjacent Z-purlins, each pair comprising one upwardly and one downwardly facing Z-purlin, or so that Z-purlins of one group face upwardly and Z-purlins of the other group face downwardly. The Z-purlins are stabilized by means of stiffeners secured to the purlins at bearing points and by means of tie straps extending between adjacent purlins.

23 Claims, 35 Drawing Figures

ROOF CONSTRUCTION WITH STABILIZED Z-PURLINS

This is a continuation of application Ser. No. 844,609, filed Oct. 25, 1977 now abandoned.

BACKGROUND OF THE INVENTION

The invention relates to a roof structure wherein a plurality of purlins, and particularly Z-purlins, are disposed across the rafters and secured thereto to constitute a secondary frame supported on the primary frame provided by the rafters which may be H-beams, I-beams or channel sections, or one of the various types of open webbed steel joists, girders or trusses. The Z-purlins constitute the secondary frame and they support directly the roof deck which may consist of steel interlocking panels. Examples of panel structures may be found in copending application Ser. No. 761,479 filed Jan. 24, 1977 in the name of Donald M. Taylor et al U.S. Pat. No. 4,102,105.

the Z-purlins of the secondary frame are subject to premature failure by rotation and lateral deflection and by web buckling which is caused by vertical loading, as for example snow loads. Because of the Z configuration, a failure by roll-over invariably occurs in a sense which would tend to open up the Z, and web crippling failure can develop at bearing points on interior rafters. It has been the practice with Z-purlins to have them placed facing in the same direction. Thus, for example, in a simple slope roof the Z cross sections of the purlins all face up the roof slope. For a double sloped roof, all purlins on each roof section are disposed to face upward toward the ridge.

SUMMARY OF THE INVENTION

The present invention has for its purpose the prevention of rotation and lateral deflection of Z-purlins and to prevent web buckling failures of Z-purlins. The results are accomplished by a combination of reorienting one or more of the Z-purlins to face in the opposite direction to the adjacent purlins on each building slope. Thus, for example, if there are six purlins on each slope of a double sloped roof, three of the purlins on each slope may be disposed to face up toward the ridge while the other three on each side may be disposed to face downwardly toward the eave. This may be in various arrangements as will be described hereinafter.

In addition to the disposition of the Z-purlins as suggested above, a tendency to web crippling failure can be reduced or eliminated by means of angle-shaped sections or welded clip plate sections referred to herein as anti-roll stiffeners. These stiffeners also help to prevent a roll-over failure of the purlins.

Additionally, tie straps may be used either between the top flanges of the purlins or the bottom flanges, or both top and bottom flanges simultaneously, or in a diagonal cross-tied arrangement. Basically the invention involves the reorientation of certain purlins and use of tie straps and/or anti-roll sitffeners is supplementary to the reorientation of the purlins.

DETAILED DESCRIPTION

Figure 1:
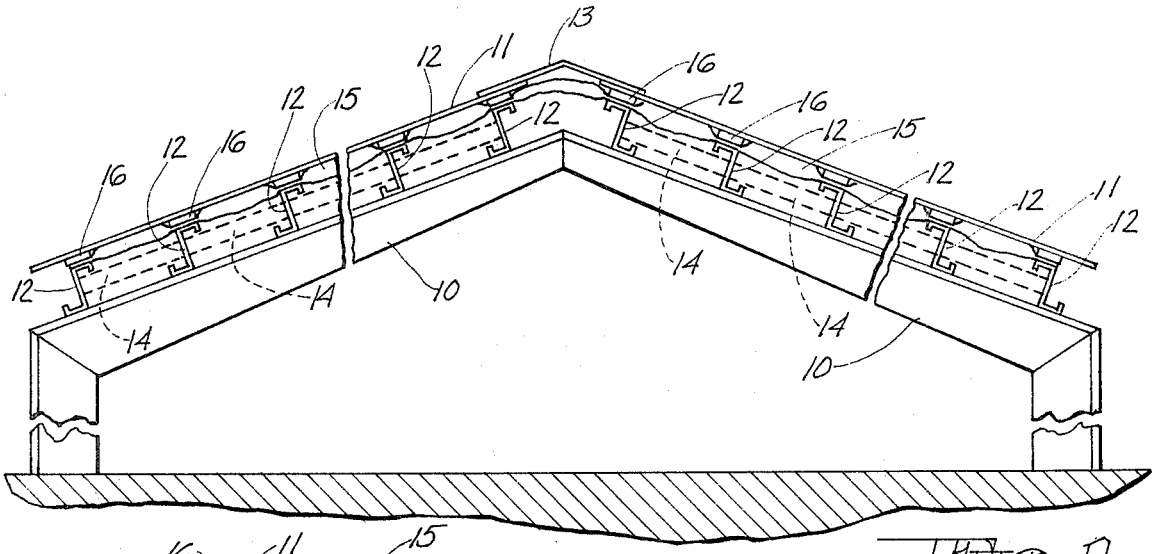
FIG. 1 PRIOR ART
FIG. 1 is a somewhat diagrammatic cross sectional view of a building roof structure showing the prior art system of arrangement of Z-purlins.
Figure 2:
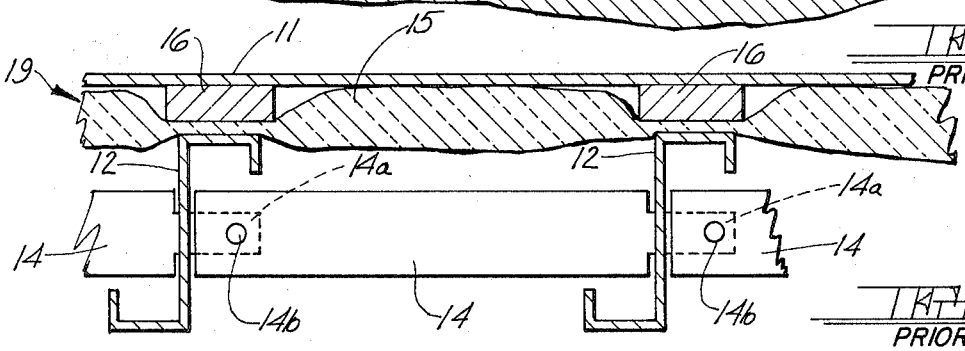
FIG. 2 PRIOR ART
FIG. 2 is an enlarged detailed cross sectional view showing a mid-span detail of the structure of FIG. 1.

In FIG. 1 there is shown a conventional arrangement in a roof construction utilizing Z-purlins. The rafters, which may be I-beams, H-beams, channel sections, open webbed steel joists, girders or trusses, are indicated at 10. The roof illustrated is a double sloped roof. The Z-purlins are indicated at 12 and in the particular embodiment illustrated there are five Z-purlins on each slope and it will be observed that the Z-purlins on the left side are oriented so as to face up toward the ridge 13 and the Z-purlins on the right side are in a reverse direction so that they also face up toward the ridge. Customarily according to present practice the purlins are connected approximately midway between rafters by purlin spacers indicated in FIG. 1 in broken lines at 14 and shown in more detail in FIG. 2. It will be observed that each of the purlin spacers is provided on one end with a tongue **14*a* having a hole and at the other end with a hole 14*b*. The Z-purlins 12 are provided with a slot through which the tongue 14*a* may pass and the tongue 14*a* of one spacer is then bolted or riveted to the other end of an adjacent purlin spacer through the holes 14*b***.

Figure 3:
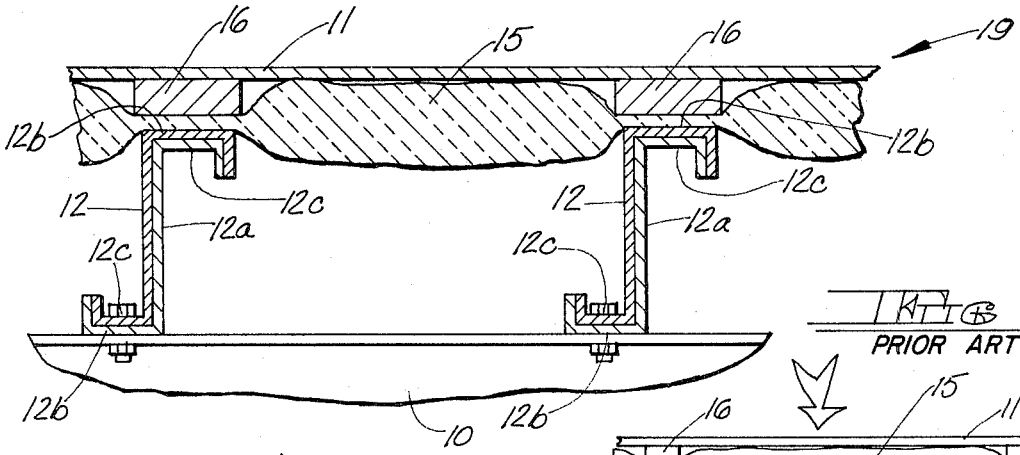
FIG. 3 PRIOR ART
FIG. 3 is a view similar to FIG. 2 but showing a rafter detail.

The purlins are spliced over the rafters in an overlapping manner as shown in FIG. 3. Thus, the purlins 12 are nested with the purlins **12*a*. This is possible since the upper flanges of the purlins 12 indicated at 12*b* are wide enough to accommodate the lower flanges 12*c*. In other words, the flange 12*c* of one purlin is nested within the flange 12*b* of another purlin and the overlapped purlins may then be bolted together. This structure is conventional. The roof deck is indicated at 19 in these Figures and it may be composed of field interlocked panels 11 having male and female elements which are telescoped together, and blanket insulation 15** as shown, for example, in copending application U.S. Ser. No. 761,479 filed Jan. 24, 1977. While the Z-purlins shown have 90° lips, they may of course have 45° lips, as shown, for example, in U.S. Pat. No. 3,973,367.

Figure 4:
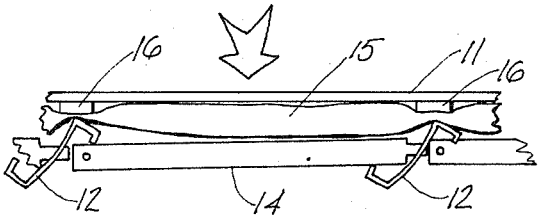
FIG. 4 PRIOR ART
FIG. 4 is a fragmentary view showing a roll-over failure at mid-span.
Figure 5:
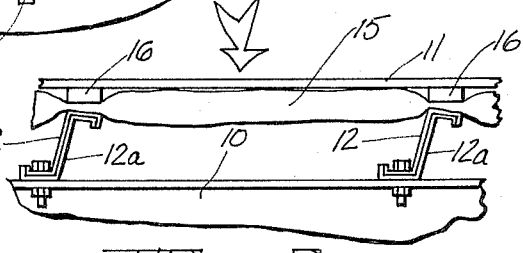
FIG. 5 PRIOR ART
FIG. 5 is a view similar to FIG. 4 but showing the roll-over failure at the rafter.
Figure 6:
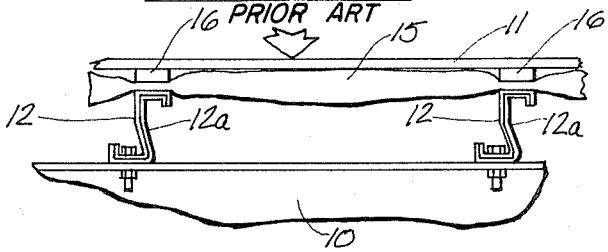
FIG. 6 PRIOR ART
FIG. 6 is a view similar to FIG. 5 but showing a web crippling failure.

In FIGS. 4 and 5, a roll-over type failure is illustrated. FIG. 5 shows the condition at the rafter while FIG. 4 shows the condition at mid-span. It will be seen that in a roll-over failure the Z-purlin tends to flatten out or open up as indicated in FIG. 5. In FIG. 4 at mid-span the purlins are also twisted and tend to break away from the purlin spacers as well as from the roof deck and the thermal blocks 16 if these are used for insulation purposes. The failures shown in FIGS. 4 to 6 may occur separately or there may be a combination of these failures.

Figure 7:
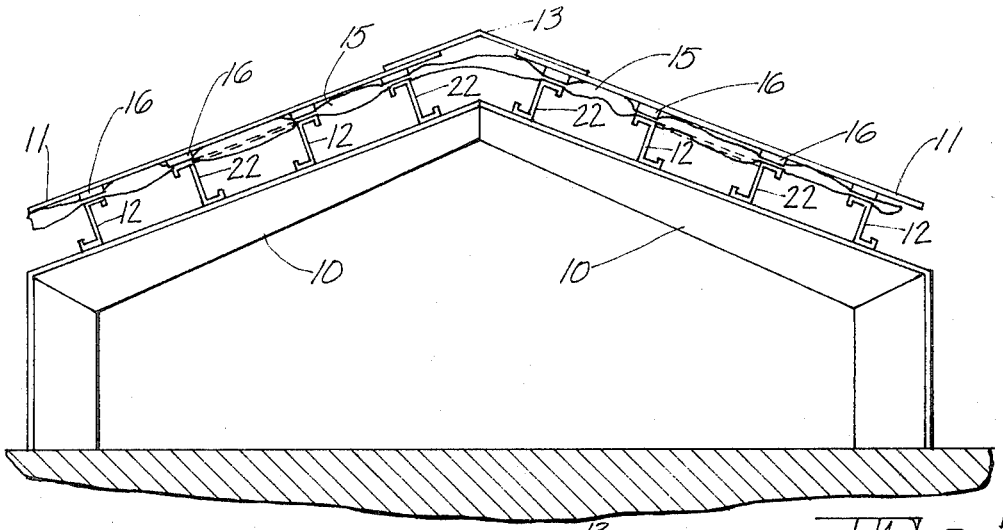
FIG. 7 is a view similar to FIG. 1 but showing a typical arrangement according to the present invention.
Figure 8:
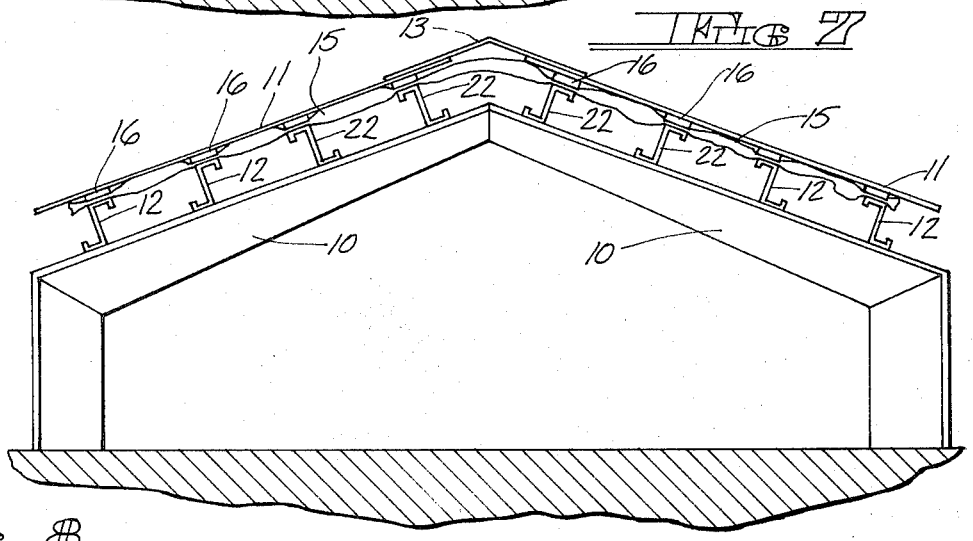
FIG. 8 is a view similar to FIG. 7 showing an alternate arrangement according to the present invention.

According to the present invention, the failures above described are minimized or entirely prevented by a reorientation of at least some of the Z-purlins. In FIG. 7 it will be observed that the Z-purlins 12 are disposed as they were in the structure of FIG. 1, i.e. facing up toward the ridge 13. However, in this construction, the Z-purlins 22, which are identical with the purlins 12, are reoriented to face in the opposite direction. In FIG. 7 the orientation alternates between adjacent purlins. In the embodiment of FIG. 8 half the purlins on each side are oriented at 180° to the others. Thus, the purlins 12 again face up toward the ridge 13 while the purlins 22 are oriented in the opposite direction. Here adjacent purlins are oriented in the same direction and another group of adjacent purlins are oriented in the opposite direction.

Figure 9:
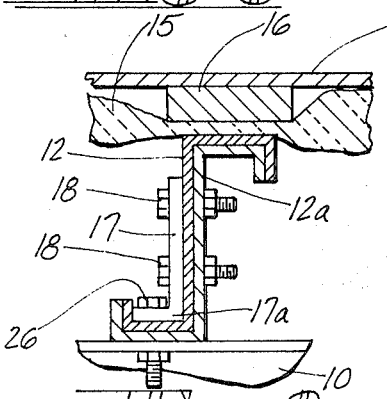
FIGS. 9, 10, 10A and 11 are enlarged fragmentary cross sectional views showing use of anti-roll stiffeners in four alternative arrangements.
Figure 10:
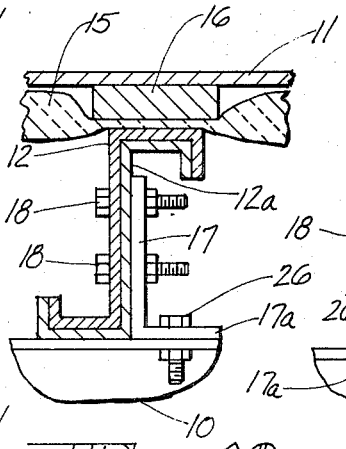
Figure 11:
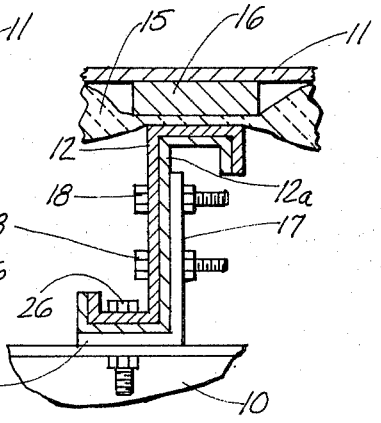

In order to prevent the web crippling type of failure, the construction shown in any of FIGS. 9 through 11 may be used along with the orientation of FIGS. 7 and 8. There is provided an anti-roll stiffener in the form of a cold formed angle or a flat plate welded to the rafter and indicated at 17. In the four FIGS. 9 to 11 inclusive, the parts are shown at the rafter where overlapping Z-purlins 12 and **12*a* are bolted together by means of bolts 18. In FIG. 9 the anti-roll stiffener 17 is bolted to the purlins 12 and 12*a* by those same bolts 18 and its short arm 17*a* is disposed within the overlapped flanges of the two purlins, and through-bolted by means of the bolts 26 or otherwise fastened to the rafter 10**.

Figure 10A:
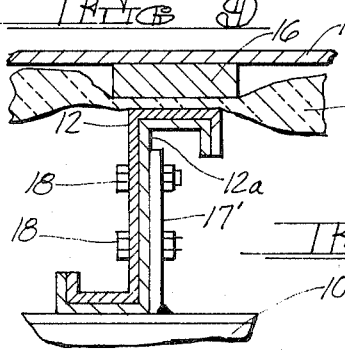

In FIG. 10 the anti-roll stiffener 17 is disposed on the other side of the overlapped purlins and is bolted to the overlapped purlin by the bolts 18 but the short arm of the anti-roll stiffener **17*a* is bolted by means of the bolts 26, or otherwise fastened to the rafter 10 without passing through the flanges of the overlapped purlins 12 and 12*a*. If the flat plate alternative is used, the plate 17' is welded to the rafter as shown in FIG. 10A** and is bolted to the overlapped purlin.

In the embodiment of FIG. 11, the anti-roll stiffener 17 is bolted as in FIG. 10 but its short arm **17*a* is faced in the opposite direction underneath the overlapped flanges of the purlins 12 and 12*a* and is through-bolted by means of the bolts 26, or otherwise fastened to the rafter 10**.

Figure 12:
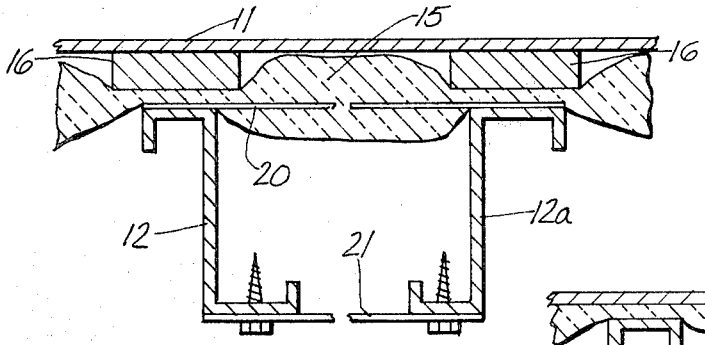
FIGS. 12 through 16 inclusive are detailed enlarged views at mid-span showing different arrangements of tie straps or braces.

In FIGS. 12 to 20 there are shown various arrangements of tie straps and braces. These are provided between rafters in various arrangements as shown in these Figures. In FIG. 12 an arrangement is shown wherein upper tie straps 20 are provided between the upper flanges of the purlins 12 and **12*a* and lower tie straps 21 are provided between the lower flanges of the purlins 12 and 12*a*. The tie straps may be fastened to the purlins by sheet metal screws, or other suitable means. The lower tie straps 21** are not required for every design loading case.

Figure 13:
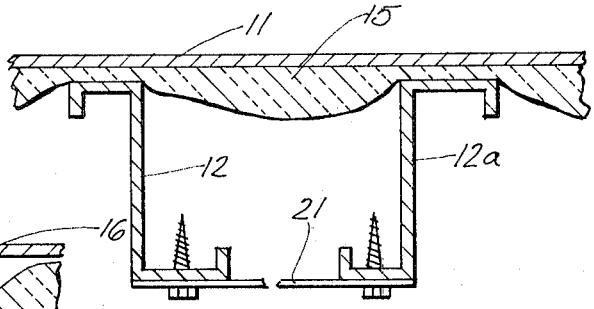

In FIG. 13 the thermal blocks 16 have been eliminated and the tie straps 21 are used with no tie straps between upper flanges of the purlins 12 and **12*a***.

Figure 14:
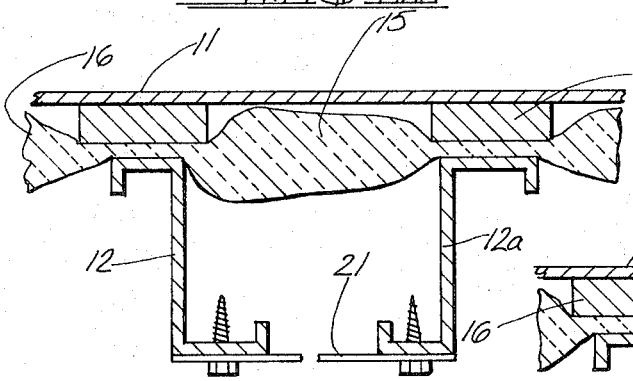

In FIG. 14 the arrangement is similar to that of FIG. 13 except the thermal blocks 16 are used.

Figure 15:
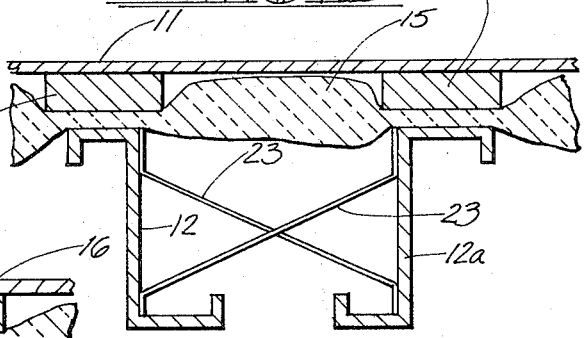

In FIG. 15 an arrangement is shown wherein the thermal blocks 16 are again employed but here diagonal cross braces 23 are used. These are fastened to the respective Z-purlins 12 and **12*a***.

Figure 16:
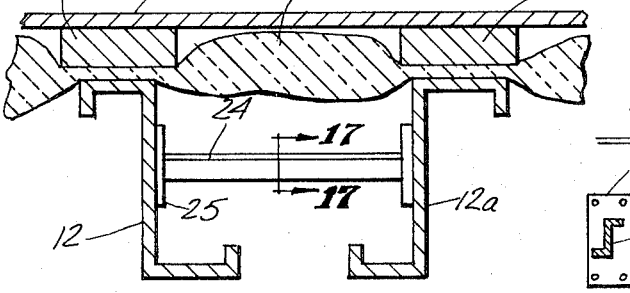
Figure 17:
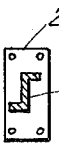
FIG. 17 is a cross sectional view taken on the line 17—17 of FIG. 16.
Figure 18:
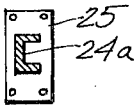
FIG. 18 is a cross sectional view similar to FIG. 17 with an alternate type of brace.

In FIG. 16 a web brace is used. This is indicated at 24 and is provided with end plates 25 which are fastened to the webs 12 and **12*a* respectively. The members 24 may be Z-shaped as shown in FIG. 17 or they may be channel shaped as shown at 24*a* in FIG. 18. The members 24 or 24*a* are welded to the plates 25 and the plates 25 may then be fastened to the webs 12 and 12*a* respectively. Plate 25 may also be integral with the member 24**.

Figure 19A:
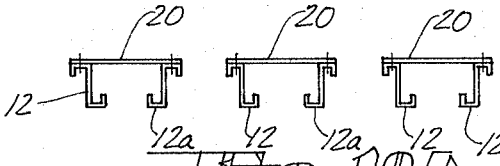
FIGS. 19, 19A, 20, 20A and 20B show different arrangements of tie straps in a diagrammatic manner for different wind loadings.
Figure 20A:
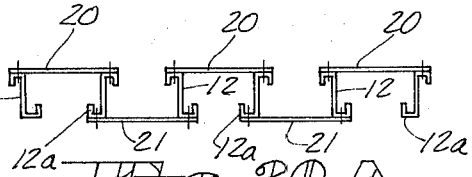
Figure 19:
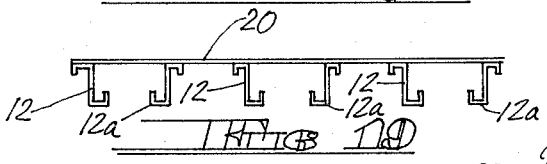
Figure 20:
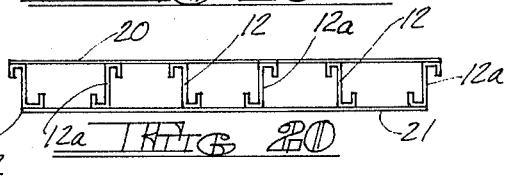
Figure 20B:
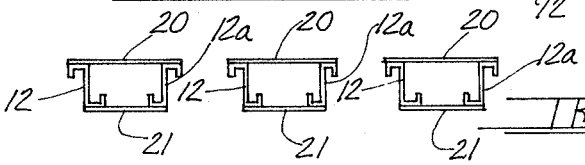

FIG. 19 diagrammatically shows an arrangement where oppositely disposed Z-purlins have upper tie straps only. This arrangement will be satisfactory for wind uplift loads of twenty-five pounds per square foot or less. In FIG. 20 a diagrammatic arrangement is shown wherein upper tie straps 20 are provided as in FIG. 19, but lower tie straps 21 are also utilized and this arrangement will be used where expected wind uplift loads will be in excess of twenty-five pounds per square foot. Straps may be continuous or in segments as shown in FIGS. 19A, 20A and 20B. Another alternative for wind uplift loads above twenty-five pounds per square foot is to replace the bottom straps 21 with web cross braces similar to 24 shown in FIGS. 16, 17 and 18.

Figure 21A:
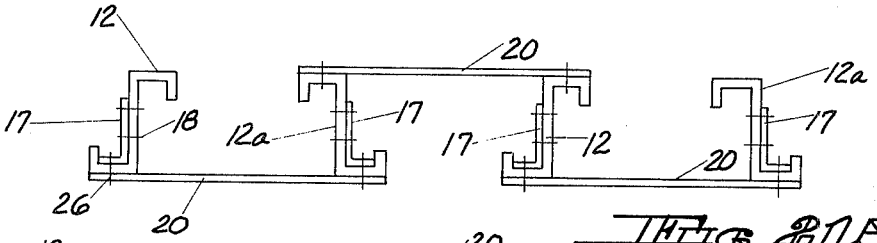
FIGS. 21A, 22A, 23A, 24A, 25A and 26A show different arrangements of tie straps, braces and anti-roll stiffeners in a diagrammatic manner for different wind loadings as used with the typical arrangement according to the present invention shown in FIG. 7.
Figure 21B:
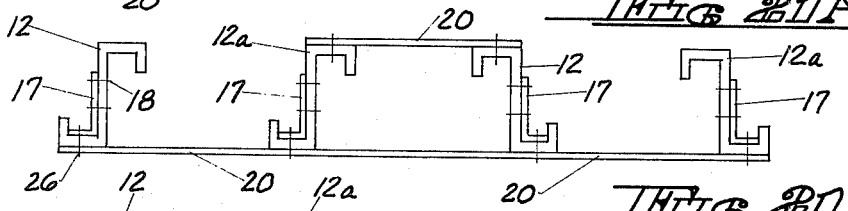
FIGS. 21B, 22B, 23B, 24B, 25B and 26B shown different arrangements of tie straps, braces and anti-roll stiffeners in a diagrammatic manner for different wind loadings as used with the alternate arrangement according to th present invention shown in FIG. 8.

FIGS. 21A and 21B show the use of anti-roll stiffeners 17 and upper and lower tie straps 20 with the arrangement of the invention as shown in FIGS. 7 and 8, respectively.

Figure 22A:
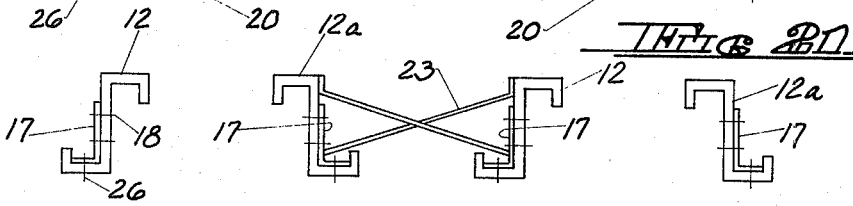
Figure 22B:
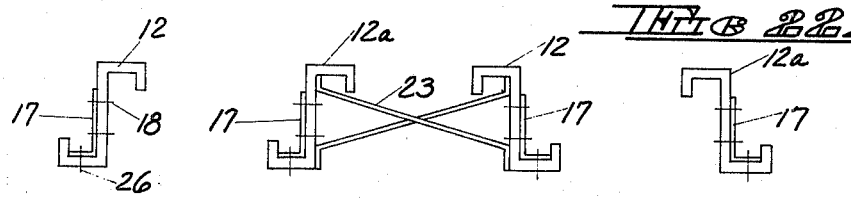

FIGS. 22A and 22B show the use of anti-roll stiffeners 17 and diagonal cross braces 23 with the arrangement of the invention as shown in FIGS. 7 and 8, respectively.

Figure 23A:
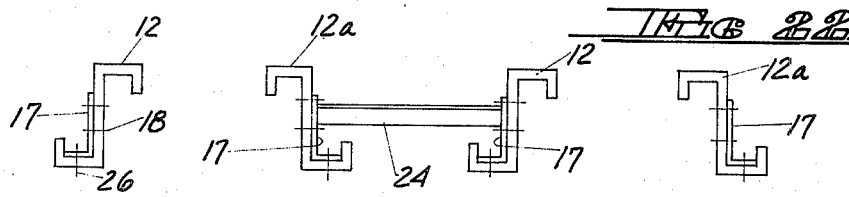
Figure 23B:
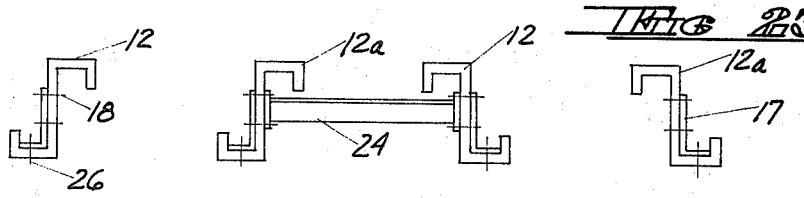
Figure 24A:
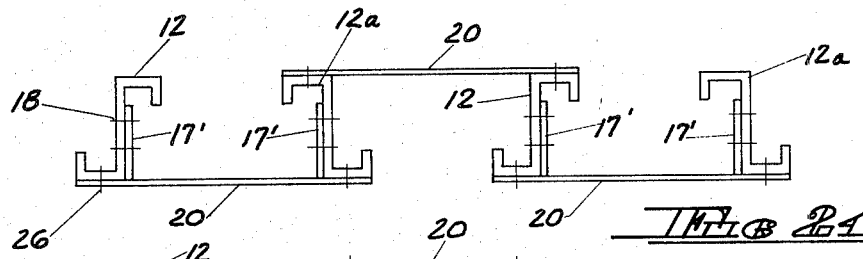
Figure 24B:
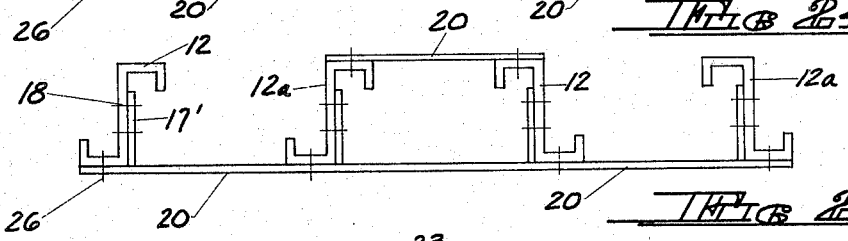

FIGS. 23A and 23B show use of anti-roll stiffeners 17 and web braces 24 with the arrangement of the invention as shown in FIGS. 7 and 8, respectively. FIGS. 24A and 24B show use of flat plates 17' and upper and lower tie straps 20 with the arrangement of the invention as shown in FIGS. 7 and 8, respectively.

Figure 25A:
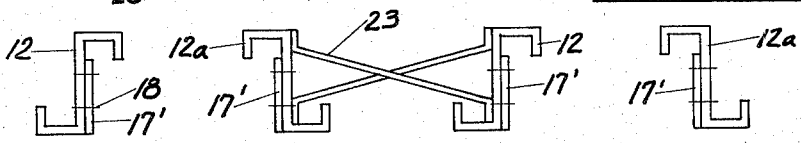
Figure 25B:
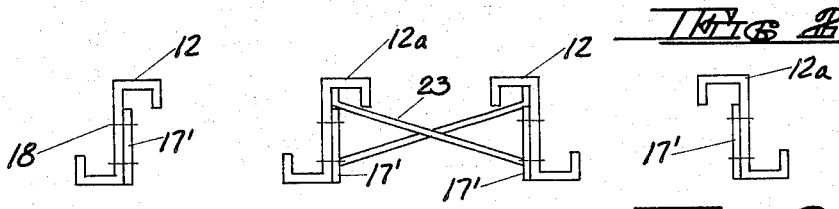

FIGS. 25A and 25B show use of flat plates 17' and diagonal cross braces 23 with the arrangement of the invention as shown in FIGS. 7 and 8, respectively.

Figure 26A:
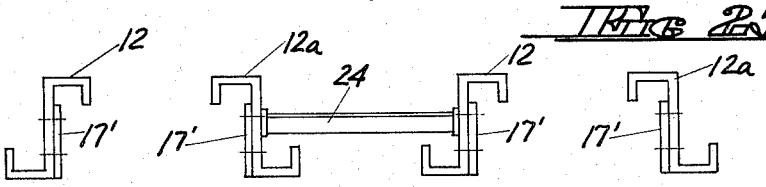
Figure 26B:
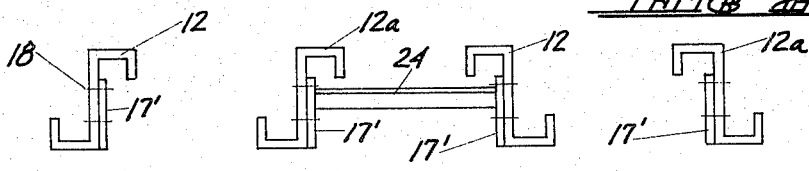

FIGS. 26A and 26B show use of flat plates 17' and web brace 24 with the arrangement of the invention as shown in FIGS. 7 and 8, respectively.

The fastening of the roof deck to the upper flanges of the purlins can be by the so-called through-fastener system or the so-called concealed fastener system such as is described in co-pending application Ser. No. 761,479 filed Jan. 24, 1977 in the name of Donald M. Taylor et al. Where concealed fasteners are used, tie straps 20 across the top flanges of the Z-purlins will be used for all design loads (see FIG. 19). The tie straps on the bottom flanges (FIG. 20) will only be necessary for wind uplift loads above twenty-five pounds per square foot.

While the reorientation of at least one purlin in a set of purlins on the slope of a roof will counterbalance tendencies toward roll-over failure, the tendency can further be resisted by the use of the anti-roll stiffeners which at the same time prevent web crippling. The use of the tie straps stabilizes the purlins between the rafters and eliminates the need for purlin spacers as has been the practice in the past.

With regard to the use of concealed fastener system as against through-fastener systems, it may be noted that the difference is really one of rigidity. When the roofing panels are fastened directly to the roof purlins they provide additional rigidity or bracing between purlins. They function rather in the same way as tie straps. However, when using the concealed fasteners as described in said copending application, a clip is sandwiched between the upstanding edge portions of the roofing panels and even though the clip secures the panels directly to the purlins, the clip acts as a flexible gap-spring element if the purlins tend to rotate. The tie straps can be of light gauge strip steel, or other suitable material.

It will be understood that numerous variations may be made without departing from the spirit of the invention and no limitation not specifically set forth in the claims is therefore intended and no such limitation should be implied.

The embodiments of the invention in which an exclusive property or privilege is claimed are defined as follows:

1. In a roof construction having a least one roof slope with an upper and lower end, said at least one roof slope having at least four Z-purlins secured to a plurality of rafters transversely thereof, each said Z-purlin having upper and lower flanges, the upper flanges of adjacent purlins being substantially spaced from each other, and a roof deck secured on top of said Z-purlins, at least two of said Z-purlins on said at least one roof slope being oriented to face downwardly of said roof slope and at least two Z-purlins on said at least one roof slope being oriented to face upwardly of said roof slope, whereby to counterbalance tendencies toward Z-purlin roll over failure.

2. The structure of claim 1 wherein full formed angle members are secured to the rafters and to the several Z-purlins to serve as anti-roll stiffeners and to prevent web crippling.

3. The structure of claim 1 wherein flat plates are welded to the rafters, and bolted to the several Z-purlins to serve as anti-roll stiffeners and to prevent web crippling.

4. The structure of claim 1 wherein between rafter locations, tie straps are secured between the upper flanges of oppositely oriented Z-purlins.

5. The structure of claim 1 wherein between rafter locations, tie straps are secured between the lower flanges of oppositely oriented Z-purlins.

6. The structure of claim 1 wherein between rafters, tie straps are secured between the upper flanges of oppositely oriented Z-purlins, and tie straps are secured between the lower flanges of oppositely oriented Z-purlins.

7. The structure of claim 1 wherein between rafters, cross braces are provided between the upper portion of the web of a Z-purlin and the lower portion of the web of an oppositely oriented Z-purlin.

8. The structure of claim 1 wherein between rafters, a horizontal brace is provided, secured to the web of adjacent, oppositely oriented, Z-purlins.

9. The structure of claim 2 wherein between rafters, tie straps are secured between the upper flanges of oppositely oriented Z-purlins.

10. The structure of claim 2 wherein between rafters, tie straps are secured between the lower flanges of oppositely oriented Z-purlins.

11. The structure of claim 2 wherein between rafters, tie straps are secured between the upper flanges of oppositely oriented Z-purlins, and tie straps are secured between the lower flanges of oppositely oriented Z-purlins.

12. The structure of claim 2 wherein between rafters, cross braces are provided between the upper portion of the web of a Z-purlin and the lower portion of the web of an oppositely oriented Z-purlin.

13. The structure of claim 2 wherein between rafters, a horizontal brace is provided, secured to the web of adjacent, oppositely oriented, Z-purlins.

14. The structure of claim 3 wherein between rafters, tie straps are secured between the upper flanges of oppositely oriented Z-purlins.

15. The structure of claim 3 wherein between rafters, tie straps are secured between the lower flanges of oppositely oriented Z-purlins.

16. The structure of claim 3 wherein between rafters, tie straps are secured between the upper flanges of oppositely oriented Z-purlins, and tie straps are secured between the lower flanges of oppositely oriented Z-purlins.

17. The structure of claim 2 wherein between rafters, cross braces are provided between the upper portion of the web of a Z-purlin and the lower portion of the web of an oppositely oriented Z-purlin.

18. The structure of claim 3 wherein between rafters, a horizontal brace is provided, secured to the web of adjacent, oppositely oriented, Z-purlins.

19. The structure according to claim 1, wherein said downwardly and upwardly oriented Z-purlins are arranged in pairs of adjacent Z-purlins, each said pair of adjacent Z-purlins comprising one upwardly and one downwardly facing Z-purlin.

20. The structure according to claim 1, wherein said upwardly and downwardly facing Z-purlins are arranged in pairs of adjacent Z-purlins, both Z-purlins of one pair facing upwardly and both Z-purlins of the other pair facing downwardly.

21. The structure according to claim 1, wherein said upwardly and downwardly facing Z-purlins are arranged in two groups of adjacent purlins, the Z-purlins of one group facing in the first direction and the Z-purlins of the second adjacent group facing in an opposite direction.

22. The structure according to claim 1, wherein said Z-purlins comprise an odd number of at least five Z-purlins, one of said Z-purlins being located along either end of said roof slope, an even number of the remainder of said Z-purlins being oriented to face downwardly of said roof slope and the rest of said remainder of said Z-purlins being oriented to face upwardly of said roof slope.

23. The structure according to claim 1, wherein one of said Z-purlins is located along the upper end of said roof slope.

* * * * *